US009578942B2

(12) United States Patent
Brilmyer et al.

(10) Patent No.: US 9,578,942 B2
(45) Date of Patent: Feb. 28, 2017

(54) CAPTURE APPARATUS FOR PORTABLE ELECTRONIC DEVICES

(71) Applicant: HIGHWATER INNOVATIONS, LLC, Johnson City, TN (US)

(72) Inventors: George H. Brilmyer, Piney Flats, TN (US); Michael E. Gilchrist, Johnson City, TN (US); Donald G. Coffman, Kingsport, TN (US)

(73) Assignee: Highwater Innovations, LLC, Johnson City, TN (US)

( * ) Notice: Subject to any disclaimer, the term of this patent is extended or adjusted under 35 U.S.C. 154(b) by 79 days.

(21) Appl. No.: 14/558,978

(22) Filed: Dec. 3, 2014

(65) Prior Publication Data

US 2016/0157572 A1 Jun. 9, 2016

(51) Int. Cl.

| | |
|---|---|
| ***A45C 11/00*** | (2006.01) |
| ***A62C 3/00*** | (2006.01) |
| *A45C 3/02* | (2006.01) |
| *A45C 13/02* | (2006.01) |

(52) U.S. Cl.

CPC ..... *A45C 11/00* (2013.01); *A62C 3/00* (2013.01); *A45C 3/02* (2013.01); *A45C 2011/003* (2013.01); *A45C 2013/025* (2013.01)

(58) Field of Classification Search

USPC ..... 220/4.01, 8, 88.1, 345.1–345.6, 560.01; 169/66; 109/33; 312/330.1, 334.1, 350, 312/402, 409; 190/29, 33, 35, 39

See application file for complete search history.

(56) References Cited

U.S. PATENT DOCUMENTS

| | | | | |
|---|---|---|---|---|
| 576,073 | A | 1/1897 | Mason | |
| 2,562,248 | A | 7/1951 | Weed | |
| 2,975,889 | A | 3/1961 | Brown | |
| 5,271,178 | A | 12/1993 | Eckard | |
| 6,824,233 | B2 * | 11/2004 | Chen | A47B 88/14 312/330.1 |
| 8,544,670 | B2 | 10/2013 | Brilmyer et al. | |

FOREIGN PATENT DOCUMENTS

| | | |
|---|---|---|
| CN | 86206003 | 4/1987 |
| EP | 2806068 A1 | 11/2014 |
| GB | 449338 | 6/1936 |
| GB | 526768 | 9/1940 |
| GB | 531387 | 1/1941 |

* cited by examiner

*Primary Examiner* — Fenn Mathew
*Assistant Examiner* — Madison L Poos
(74) *Attorney, Agent, or Firm* — Luedeka Neely Group, PC

(57) ABSTRACT

A capture apparatus and method for safely picking up and moving a portable electronic device into a fire containment case. The apparatus includes a tray portion having a rectangular base, opposing sides orthogonal to the base, tapered rod attached to the rectangular base between the opposing sides, and slide rails attached to the opposing sides. A lid portion is also provided and includes five sides of a rectangular prism-shaped structure defining a cavity within the apparatus for holding the malfunctioning portable electronic device. The lid portion has a first handle on a first side end, a second handle on a cover portion orthogonal to the first side end, and opposing sides attached to the cover, the first side end and a second side end. The first side end and the second side end of the lid portion include slides for slidable engagement with the slide rails of the tray portion.

15 Claims, 6 Drawing Sheets

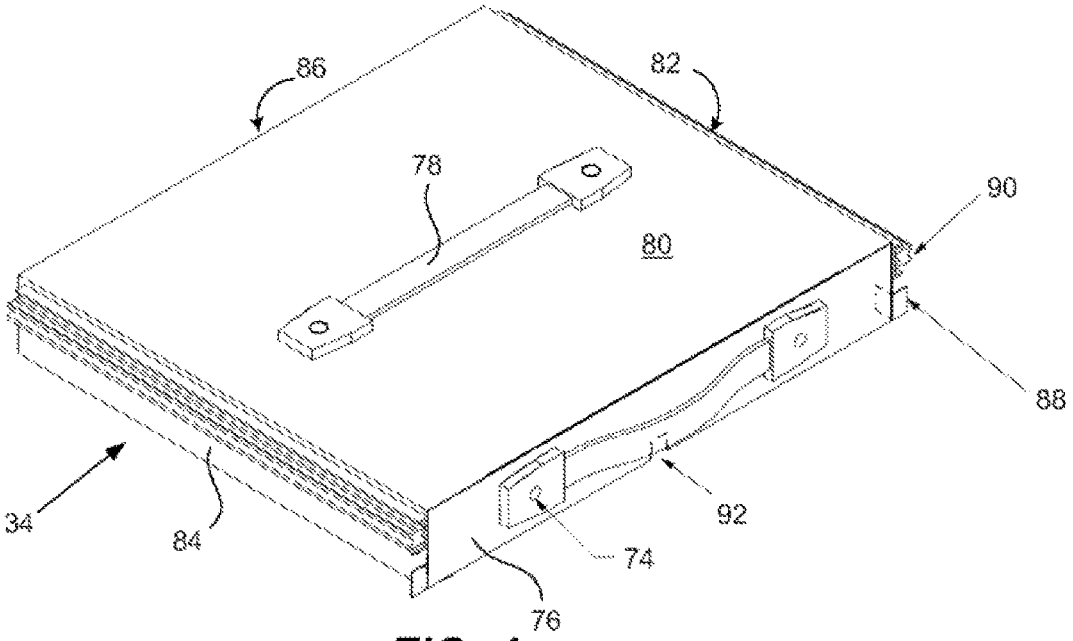
FIG. 4
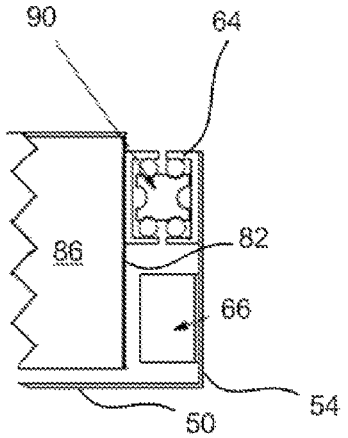
FIG. 5 Section A-A of FIG. 2

CAPTURE APPARATUS FOR PORTABLE ELECTRONIC DEVICES

TECHNICAL FIELD

The disclosure relates to heat and fire containment enclosures used to isolate a fire event in portable electronic equipment that may be subject to rapid intense combustion due to malfunction of the battery (typically a Li-ion battery) or charging system therefor. More specifically the disclosure relates to a capture apparatus for capturing a portable electronic device that has malfunctioned and begun to combust.

BACKGROUND AND SUMMARY

A fire containment case for use in private vehicles and on public transportation vehicles is disclosed in U.S. Pat. No. 8,544,670 and shown in FIG. 1. The fire containment case provides a secure apparatus for selectively receiving and securing a portable electronic device and their batteries in the event of malfunction and combustion of the electronic device. The case is made of heat resistance construction to contain and control products of combustion from the device.

Typically, such combustion is occurring on a more frequent basis as people as passengers carry more and more personal electronic devices such as cell phones, laptop computers, tablet computers, e-readers and other such devices that are powered by Li-ion batteries. Combustion events occur when the battery experiences a condition referred to as thermal runaway which proceeds exceedingly rapidly making it difficult to move the portable device from its remote location to inside the containment case without endangering anyone. For example, if a battery of a portable computer malfunctions and begins to burn on an airplane, the flight attendant may be charged with safely and quickly fighting the fire and/or moving the portable computer to the fire containment case. However, by the time the problem is noticed and the case is retrieved from a storage location on the plane, the portable computer may be actively burning, reaching temperatures that exceed several hundred degrees centigrade. While the fire containment case is particularly useful for safely holding a portable device that may have malfunctioned and is actively burning or combusting, there is a need for an improved apparatus for moving the portable electronic device from a remote location to into the containment case once the portable device is already burning. The transfer device described in U.S. Pat. No. 8,544,670 is functional, but still requires personal contact with burning portable electronic device, though with a gloved hand. Accordingly, an apparatus that can capture a portable electronic device that is actively burning is need for use with the fire containment case.

In view of the foregoing, an embodiment of the disclosure provides a capture apparatus and method for safely picking up and moving a portable electronic device into a fire containment case. The apparatus includes a tray portion having a rectangular base, opposing sides orthogonal to the base, tapered rod attached to the rectangular base between the opposing sides, and slide rails attached to the opposing sides. A rectangular lid portion is provided having five sides of a rectangular prism-shaped structure wherein an open side of the structure and the rectangular base define a cavity within the apparatus for holding the malfunctioning portable electronic device. The lid portion has a first handle on a first side end thereof, a second handle on a cover portion orthogonal to the first side end, and opposing sides attached to the cover, the first side end and a second side end. The first side end and the second side end further include slides for slidable engagement with the slide rails of the tray portion.

In another embodiment there is provided a method for safely approaching and picking up a malfunctioning portable electronic device and inserting the device into a fire containment case. The method includes providing a capture apparatus having a tray portion having a rectangular base, opposing sides orthogonal to the base, tapered rod attached to the rectangular base between the opposing sides, and slide rails attached to the opposing sides. The capture apparatus also has a rectangular lid portion having five sides of a rectangular prism-shaped structure wherein an open side of the structure and the rectangular base define a cavity within the apparatus for holding the malfunctioning portable electronic device. The lid portion has a first handle on a first side end thereof, a second handle on a cover portion orthogonal to the first end, and opposing sides attached to the cover, the first side end and a second side end. The first side end and the second side end further include slides for slidable engagement with the slide rails of the tray portion. During a capture operation, the lid portion is slid from a closed position to an opened position and the portable electronic device is approached using the capture apparatus as a shield. The portable electronic device is then covered with the lid portion and the tray portion is slid under the portable electronic device so that the portable electronic device is disposed within the cavity of the apparatus. Once captured with the apparatus, the capture apparatus containing the portable electronic device is inserted into the fire containment case.

Yet another embodiment provides a capture apparatus for moving a portable electronic device into a fire containment case. The capture apparatus includes a slidably engaged tray and cover defining a rectangular prism having a cavity therein wherein the tray includes a tapered rod for lifting the portable electronic device sufficient to slide the tray under the portable electronic device.

An advantage of the method and apparatus of the disclosed embodiments is that a malfunctioning portable electronic device can be safely captured and disposed of in a fire containment case quickly and without having to expose personal to burn hazards associated with grabbing the portable electronic device by hand. The entire capture device is sized so that it fits easily into a fire containment case for disposing of the device with minimal exposure to fire and toxic fumes. Other features and advantages of the disclosed embodiments may be evident from the following detailed description of exemplary embodiments of the disclosure.

BRIEF DESCRIPTION OF THE DRAWINGS

FIG. 4 is a perspective view, not to scale, of a lid portion of a capture apparatus for a portable electronic device according to an embodiment of the disclosure.

FIG. 5 is a cross-sectional view, not to scale through section A-A of the apparatus of FIG. 1.

DETAILED DESCRIPTION OF THE INVENTION

Figure 1:
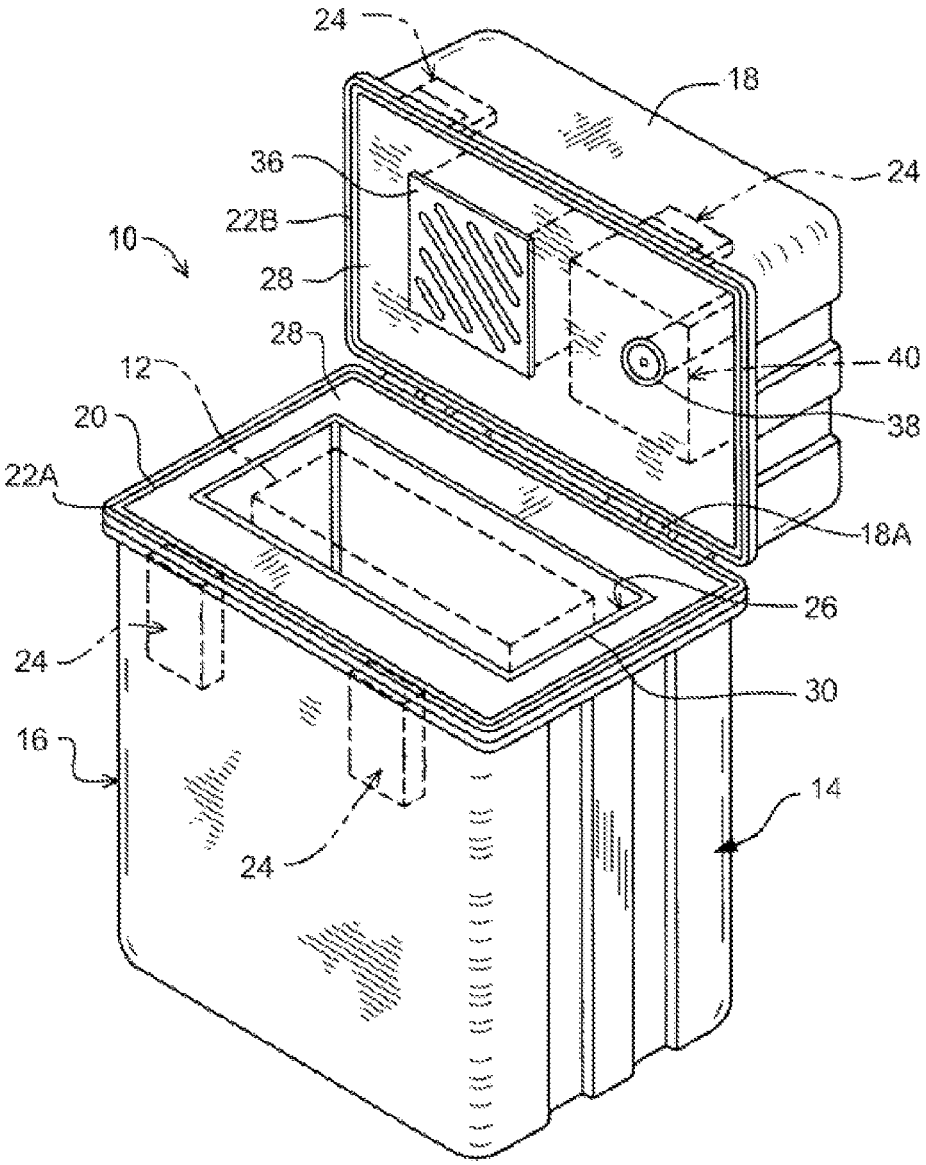
FIG. 1 is a perspective view of a fire containment case for a capture device for a portable electronic device.

Referring now to FIG. 1 of the drawings, a fire containment case 10 can be seen for receiving a capture apparatus 12 for a portable electronic that may be on fire. The containment case 10 has a main exterior housing 14 defined of a base portion 16 and a hinge closure portion 18 having hinge assemblies 18A. The exterior housing 14 is preferably of a rectangular configuration of a known size and dimension to accommodate and receive the capture apparatus 12 for portable electronic equipment therewithin. An airtight sealing gasket assembly is provided and formed by the respective perimeter engagement flanges 22A and 22B of the base and closure portions 16 and 18 and a gasket 20. A common latch system 24 assures closure portion 18 retainment and secures the housing 14 with the sealing gasket assembly.

The containment case 10 has an internal receiving case 26 formed within the exterior case housing 14 of the case 10 with thermal flame retardant insulation 28 infilling between the internal receiving case 26 and the exterior housing 14. Additionally, a flame proof liner 30 surrounds a receiving chamber defined by the internal receiving case 26.

Figure 2:
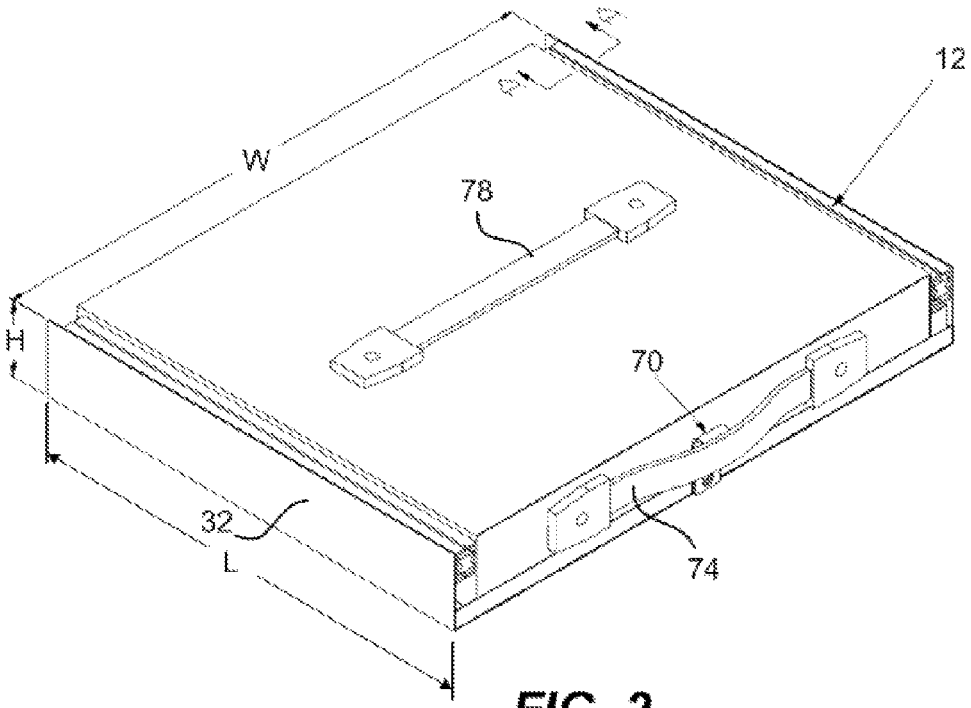
FIG. 2 is a perspective view, not to scale, of a capture apparatus for a portable electronic device according to an embodiment of the disclosure.
Figure 3:
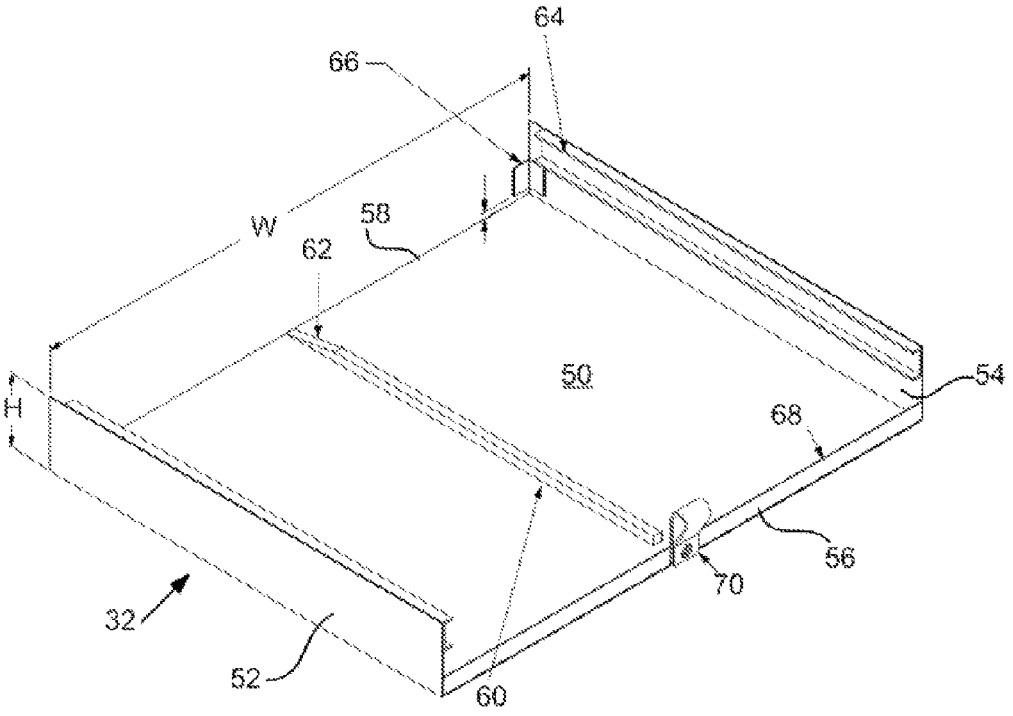
FIG. 3 is a perspective view, not to scale, of a tray portion of a capture apparatus for a portable electronic device according to an embodiment of the disclosure.

The capture apparatus 12, as best seen in FIG. 2 of the drawings, is generally of a rectangular prism-shaped configuration having an interior cavity disposed between a rectangular tray portion 32 and a rectangular lid portion 34. The capture apparatus 12 is of an overall dimension less than that of the internal receiving case 26 so as to be slidably received therewithin. Further important features of the capture apparatus 12 are described in more detail below.

Referring again to FIG. 1, the thermal insulation 28 for the containment case 10 may be of a passive static material chosen from a variety of thermal insulation materials currently available commercially or alternately of an active thermal material. Such an active thermal insulation material may be a phase change material based on inorganic salts or organic waxes that absorb heat and therefore helps to maintain a safe handling temperature for containment case housing 14.

As shown in FIG. 1, the containment case 10 has a gas and fume collection filter and retainment system 36 in communication with the interior of the internal receiving case 26. The gas and fume system 36 in this example is positioned in the insulated closure portion 18 and may include multiple filter zones including, for example, an initial particle filter, a gas fume filter, and an optional chemical zone filter to collect and retain dangerous gases such as carbon monoxide and cyanide that may result from the burning of synthetic resin based materials during combustion. The filter system 36 vents treated gases to atmosphere from the containment case 10.

A fire suppression system 38 may be included in the closure portion 18 of the case 12 for injecting water therethrough into the internal receiving case 26, if needed to cool the contents of the case 26 and/or to suppress any fire in the case 26. As an additional alternate fire suppression venue, an alternate canister dispenser 40 of thermal insulating fire retardant foam may be provided. The canister disperser 40 of foam would be activated once the case is closed during active use in the presence of burning equipment positioned therewithin. Such firefighting foam is released into the respective internal receiving case 26 to effectively control gases and temperature and extinguish the fire and is illustrated in broken lines as an alternate suppression system in the closure portion 18.

The sealing gasket assembly is defined by the pair of elongated contoured continuous integrated engagement flanges 22A and 22B extending respectively about the open end edges of the base portion 16 and closure portion 18, as shown. In this example, an O-ring sealing gasket 20 is fitted within a channel in the flange 22A and provides an airtight seal between the base portion 16 and the closure portion 18 of the case 10 when engaged and secured by the latch assembly 24. The case housing 14 construction is preferably defined as aluminum or a heat resistant synthetic resin while an interior wall or liner 30 of the internal receiving case 26 is of preferably made of aluminum sheet material.

Referring now to FIGS. 2-6, details of the capture apparatus 12 will be described. The capture apparatus 12 is configured for safely picking up and moving a portable electronic device into the fire containment case 10 (FIG. 1). The tray portion 32 of the apparatus 12 is shown in detail in FIG. 3 and includes a rectangular base 50 having opposing sides 52 and 54 orthogonal to the base 50, a first end 56 and a second end 58. A tapered rod 60 attached to the rectangular base 50 substantially midway between the opposing sides 52 and 54 and extends between the first end 56 and second end 58 of the base 50. The rod 60 has a tapered end 62 adjacent the second end 60 of the base 50 for lifting a portable electronic device off of its feet so that the tray 32 can be slid under the device. Slide rails 64 are attached to the opposing sides 52 and 54 for slidably engaging the lid portion 34. At least one stop 66 and preferably two stops 66 are provided adjacent the send end of the base 50 attached to the base 50 or side walls 52 and 54 for limiting the open movement of the lid portion 34.

The tray portion 32 has a width W and the side walls 52 and 54 have a height H sufficient for capturing a portable electronic device such as a lap-top computer. Accordingly, the width W may range from about 30 centimeters to about 60 centimeters and the height H may range from about 3 centimeters to about 15 centimeters and a length L may range from 15 to 40 centimeters. A lid closure stop 68 may be provided adjacent the first end 56 of the base 50 for limiting the movement of the lid portion 34 in the closed position. The closure stop 68 may be provided by a turned up edge of the base 50 or by individual angle brackets attached to the base 50. A pull 70 is provided on the first end 56 of the base 50 for holding the tray portion 32 stationary as the lid portion 34 is opened. In an alternative embodiment, a latching mechanism (not shown) may be used to hold the tray portion 32 and lid portion 34 in a closed position after a burning portable electronic device has been captured by the apparatus 12.

The rectangular lid portion 34 is shown in more detail in FIG. 4. The lid portion 34 is defined by five sides of a rectangular prism-shaped structure wherein an open side of the structure and the rectangular base 50 of the tray portion 32 define a cavity within the apparatus 12 for holding the portable electronic device. The lid portion 34 having a first handle 74 on a first side end 76 thereof and a second handle 78 on a cover portion 80 orthogonal to the first side end 76. Opposing sides 82 and 84 are attached to the cover 80, the first side end 76 and a second side end 86. At least one stop 88 and preferably two stops 88 are provided on the first side end 76 of the lid portion 34 for stopping engagement with the stops 66 of the tray portion 32 when the lid portion 34 is in a fully opened position as shown in FIG. 6

A slide mechanism 90 is attached to the opposing sides 82 and 84 for sliding engagement with the slide rails 64 on the tray portion 32. The slide mechanism 90 is shown in more detail in FIG. 5. The slide mechanism 90 may be provided by a conventional drawer slide device, such as a ball-bearing drawer slide as shown in FIG. 5 or any other low friction slide mechanism. An important feature of the disclosed embodiments is that the lid portion 34 is rapidly and easily moved from an opened to a closed position and vice versa so that a portable electronic device can be captured in as short a time as possible and disposed of in the containment case 10. A notched opening 92 is provided in the first side end 76 of the lid portion 34 so that the lid portion may slide over the tapered rod 60 attached to the tray portion 32.

Figure 6:
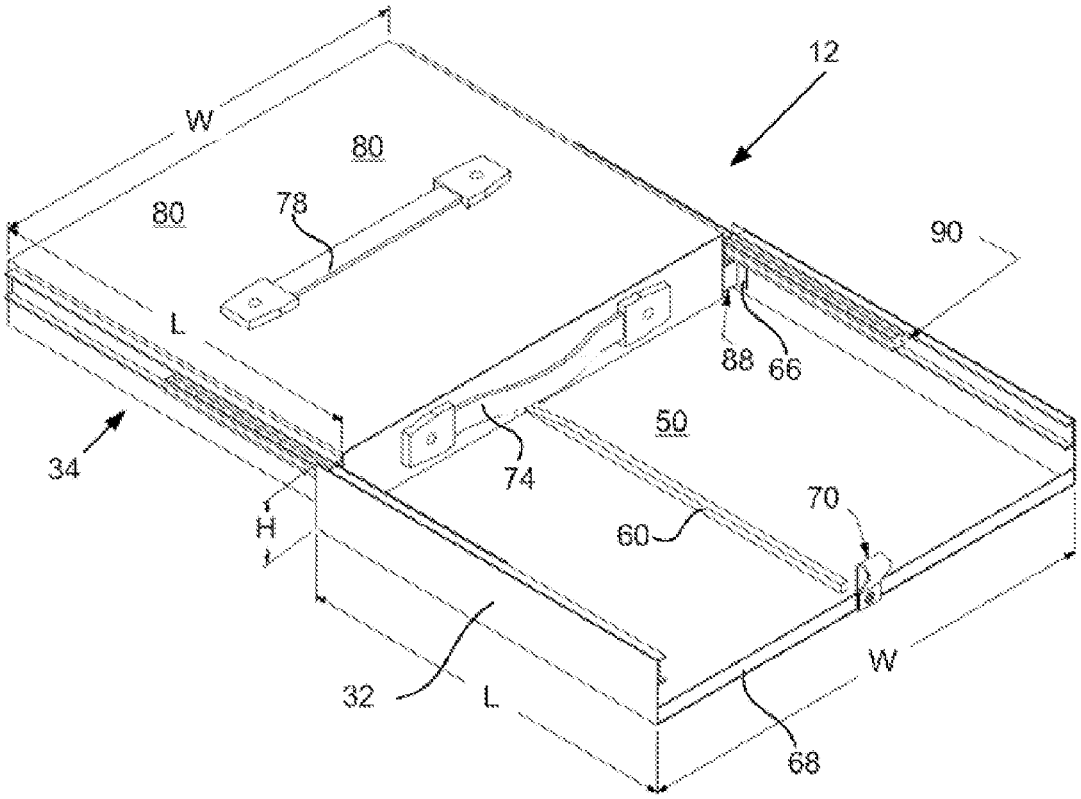
FIG. 6 is a perspective view, not to scale, of a capture apparatus for a portable electronic device according to an embodiment of the disclosure in a first position for capturing an electronic device.
Figure 7:
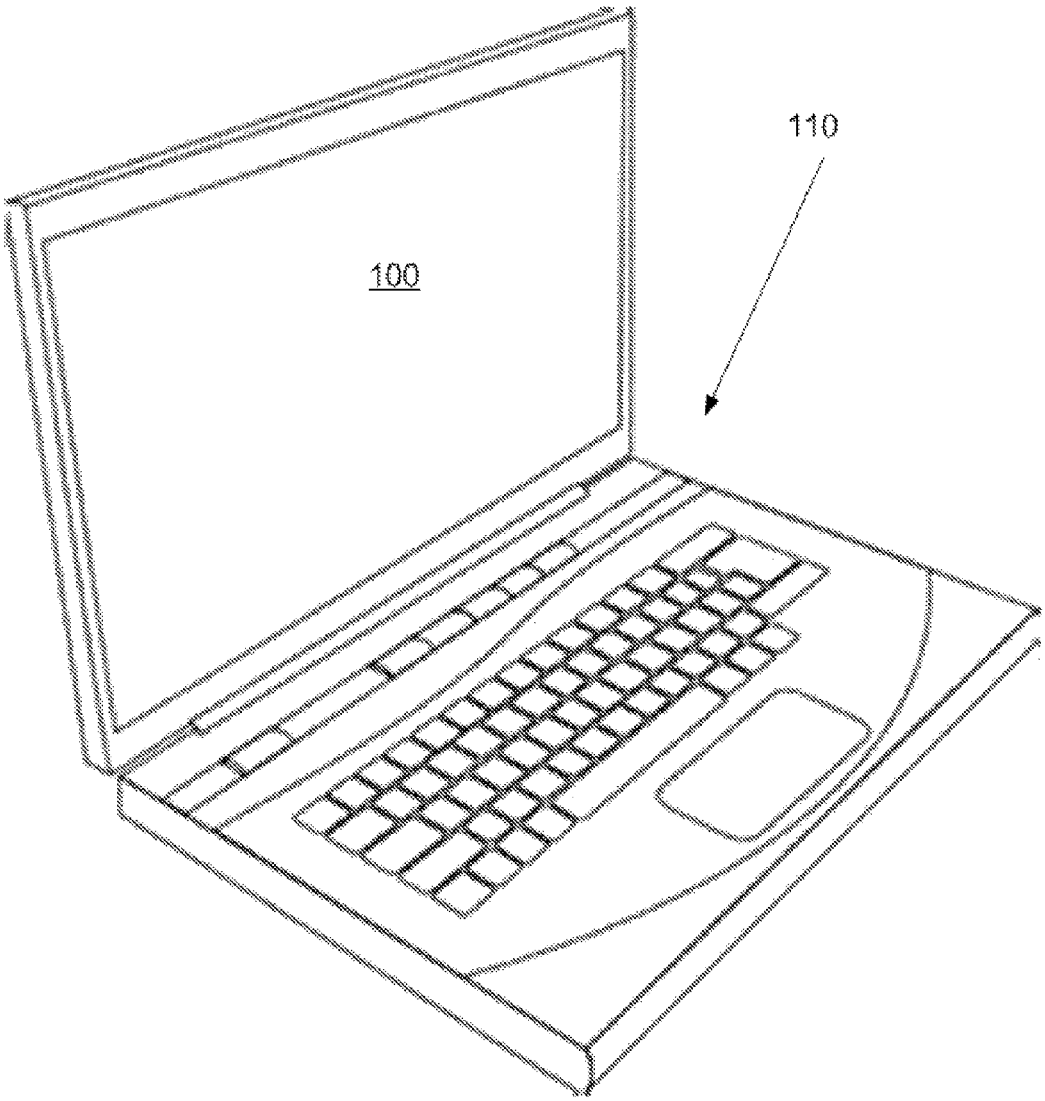
FIG. 7 is a perspective view of a portable computer that may be captured by the capture apparatus of the disclosure.

FIG. 6 illustrates a capture position for the capture apparatus 12 according to the disclosure. In the capture position, the lid portion 34 is slid toward the second end 58 of the tray portion 32 using handle 78 so that stop 66 on the tray portion engages stop 88 on the lid portion 34. When being held by the handle 78 and the pull 70, the open capture apparatus 12 may be used as a personal shield to protect personal from a burning portable electronic device. The cover portion 80 of the lid portion 34 may also be used to close a screen 100 of a portable electronic device such as a portable computer 110 FIG. 7. Once the screen 100 is closed, the tray portion may be slid under the computer 110 using tapered rod 60 to assist in lifting the computer 110 off of its support feet so that the tray portion 32 can be quickly and easily slid under the computer 110 and the capture apparatus closed with the computer in the cavity formed by the lid portion 34 and the tray portion 32 of the apparatus 12. Once closed (FIG. 2), handle 74 may be used to pick up the apparatus 12 containing the computer 110 in order to insert the apparatus 12 into the containment case 10, described above.

The description and illustration of one or more embodiments provided in this application are not intended to limit or restrict the scope of the invention as claimed in any way. The embodiments, examples, and details provided in this application are considered sufficient to convey possession and enable others to make and use the best mode of claimed invention. The claimed invention should not be construed as being limited to any embodiment, example, or detail provided in this application. Regardless of whether shown and described in combination or separately, the various features (both structural and methodological) are intended to be selectively included or omitted to produce an embodiment with a particular set of features. Having been provided with the description and illustration of the present application, one skilled in the art may envision variations, modifications, and alternate embodiments falling within the spirit of the broader aspects of the general inventive concept embodied in this application that do not depart from the broader scope of the claimed invention.

What is claimed is:

1. A capture apparatus for safely picking up and moving a portable electronic device into a fire containment case, the apparatus comprising, a tray portion having a rectangular base, opposing sides orthogonal to the base, and slide rails attached to the opposing sides; and a rectangular lid portion, the lid portion comprising five sides of a rectangular prism-shaped structure wherein an open side of the structure and the rectangular base define a cavity within the apparatus for holding a malfunctioning portable electronic device, the lid portion having a first handle on a first side end thereof, a second handle on a cover portion orthogonal to the first side end, and opposing sides attached to the cover portion, the first side end and a second side end, wherein the first side end and the second side end further comprise slides for slidable engagement with the slide rails of the tray portion.

2. The capture apparatus of claim 1, further comprising a tapered rod attached to the rectanular base between the opposing sides.

3. The capture apparatus of claim 1, wherein the tray portion comprises at least one tray stop adjacent the second end thereof and the lid portion comprises at least one lid stop adjacent the first end thereof for stopping engagement with the at least one tray stop.

4. The capture apparatus of claim 1, wherein the tray portion comprises two tray stops adjacent the send end thereof and the lid portion comprises two lid stops adjencent the first end thereof.

5. The capture apparatus of claim 1, wherein the slides comprise ball-bearing drawer slides.

6. The capture apparatus of claim 1, wherein the tray portion comprises a tray pull on a first end thereof for holding the tray as the lid portion is moved.

7. The capture apparatus of claim 1, wherein the cavity has a size sufficient to contain a portable laptop computer.

8. The capature apparatus of claim 1, wherein the apparatus has a size suitable for fittting into a fire containment case.

9. A method for safely approaching and picking up a malfuctioning portable electonic device and inserting the device into a fire containment case, comprising:

providing a capture apparatus comprising, a tray portion having a rectangular base, opposing sides orthogonal to the base, and slide rails attached to the opposing sides; and a rectangular lid portion, the lid portion comprising five sides of a rectangular prism-shaped structure wherein an open side of the structure and the rectangular base define a cavity within the apparatus for holding the malfunctioning portable electronic device, the lid portion having a first handle on a first side end thereof, a second handle on a cover portion orthogonal to the first end, and opposing sides attached to the cover portion, the first side end and a second side end, wherein the first side end and the second side end further comprise slides for slidable engagement with the slide rails of the tray portion;

sliding the lid portion from a closed position to an opened position;

approaching the portable electronic device using the capture apparatus as a shield;

covering the portable electronic device with the lid portion;

sliding the tray portion under the portable electronic device so that the portable electronic device is disposed within the cavity of the apparatus; and inserting the capture apparatus containing the portable electronic device into the fire containment case.

10. The method of claim 9, wherein the capture apparatus comprises a tapered rod attached to the rectangular base between the opposing sides for use in lifting a portable electonic device off of its feet as the tray portion is slid under the device.

11. The method of claim 9, wherein the tray portion comprises a tray pull on a first end thereof, further comprising holding the tray with the tray pull as the lid portion slid from the closed position to the opened position.

12. The method of claim 9, further comprising using the opened lid portion of the capture apparatus to close a display portion of a portable elecctronic device before sliding the tray portion under the portable elecctronic device.

13. A capture apparatus for moving a portable electronic device into a fire containment case, the capture apparatus comprising a slidably engaged tray and cover defining a rectangular prism having a single cavity therein wherein the cover has a first handle on a first side end thereof, a second handle on a cover portion orthogonal to the first side end, and opposing sides attached to the cover portion, the first side end and a second side end, and wherein the first side end and the second side end further comprise slides for slidable engagement with slide rails on the tray.

14. The capture apparatus of claim 13, further comprising a pull tab on the tray for slidably opening the apparatus to capture a portable electronic device.

15. The capture apparatus of claim 13, further comprising stops on the tray and cover for preventing disengagement of the cover from the tray as the apparatus is slidably opened to a capture position.

* * * * *